US007827877B2

(12) United States Patent
Lin et al.

(10) Patent No.: US 7,827,877 B2
(45) Date of Patent: Nov. 9, 2010

(54) GEAR-ROLLING APPARATUS

(75) Inventors: Wei-Fong Lin, Hsinchu (TW); Wei-Yuan Peng, Hsinchu (TW); Min-Hsi Lin, Hsinchu (TW); Shao-Tzu Hsu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 720 days.

(21) Appl. No.: 11/840,071

(22) Filed: Aug. 16, 2007

(65) Prior Publication Data

US 2009/0044586 A1 Feb. 19, 2009

(51) Int. Cl.
*F16H 1/00* (2006.01)
*F16D 1/02* (2006.01)

(52) U.S. Cl. ..... 74/421 R; 403/215; 403/289; 403/329; 403/354; 464/179

(58) Field of Classification Search ..... 74/414, 74/421 R, 606 R; 403/206, 215, 289, 329, 403/354, 383; 464/179, 181
See application file for complete search history.

(56) References Cited

U.S. PATENT DOCUMENTS 3,056,618 A * 10/1962 Andersen ..... 403/354
3,057,647 A * 10/1962 Wood ..... 403/2
5,143,477 A * 9/1992 Kanehira et al. ..... 403/341
6,126,356 A * 10/2000 Russell ..... 403/24
6,203,238 B1 * 3/2001 Otto ..... 403/354
6,322,282 B1 * 11/2001 Kussman et al. ..... 403/329
6,412,163 B1 * 7/2002 Russell ..... 74/421 R

* cited by examiner

*Primary Examiner*—William C Joyce
(74) *Attorney, Agent, or Firm*—Birch, Stewart, Kolasch & Birch, LLP

(57) ABSTRACT

A gear-rolling apparatus includes two gear units and a base. Each gear unit has a rolling portion, a rolling shaft extends from the rolling portion, a clicking column and two location columns extend from edges of a free end of the rolling shaft along an axle direction of the rolling shaft. The clicking column and the two location columns are spaced out from each other to form three grooves therebetween, a clicking clasp extends inward from the top of the clicking column. The clicking clasp has an inclined inner surface which inclines inward from top to bottom. The two rolling shafts are inserted into the hole of the base, the clicking column of one of the rolling shafts mates the groove opened between the location columns of the other rolling shaft, the location columns of one of the rolling shafts mate the grooves opened between the clicking column and the location columns of the other rolling shaft respectively, bottom surfaces of the two clicking clasps are against each other.

7 Claims, 5 Drawing Sheets

GEAR-ROLLING APPARATUS

BACKGROUND OF THE INVENTION

1. Field of the Invention

This present invention relates to a rolling apparatus, and more specifically to a gear-rolling apparatus.

2. The Related Art

Please refer to FIG. 7, a traditional gear-rolling apparatus 10 is described below. The traditional gear-rolling apparatus 10 comprises a left gear 210, a right gear 220, a rolling bar 230 and a base 300. The left gear 210 is the same as the right gear 220. The base 300 is used for holding the gear-rolling apparatus 10. A hole 310 is opened in the base 300. When the traditional gear-rolling apparatus 10 is assembled, the left gear 210 is fixed in one end of the rolling bar 230, then the other end of the rolling bar 230 passes through the hole 310, the right gear 220 is fixed in the other end of the rolling bar 230. When the left gear 210 is driven, the left gear 210 drives the rolling bar 230 and the right gear 220, so the left gear 210 and the right gear 220 roll at the same time.

The traditional gear-rolling apparatus 10 is made by two molds, one mold is used for molding the left gear 210 and the right gear 220, the other mold is used for molding the rolling bar 230. The manufacture cost of the traditional gear-rolling apparatus 10 is increased for the two molds. The assembled action of the traditional gear-rolling apparatus 10 is complicated for the assembled action including three actions.

SUMMARY OF THE INVENTION

It is therefore an object of the present invention to provide a gear-rolling apparatus, which can solve the foregoing problem.

The gear-rolling apparatus includes two gear units and a base. Each gear unit has a rolling portion, a rolling shaft extends from the rolling portion, a clicking column and two location columns extend from edges of a free end of the rolling shaft along an axle direction of the rolling shaft. The clicking column and the two location columns are spaced out from each other to form three grooves therebetween, a clicking clasp extends inward from the top of the clicking column. The clicking clasp has an inclined inner surface which inclines inward from top to bottom. The two rolling shafts are inserted into the hole of the base, the clicking column of one of the rolling shafts mates the groove opened between the location columns of the other rolling shaft, the location columns of one of the rolling shafts mate the grooves opened between the clicking column and the location columns of the other rolling shaft respectively, bottom surfaces of the two clicking clasps are against each other.

As described above, the present invention is achieved by the two rolling shafts, using the clicking column and the location columns of the rolling shaft to fix the two gear units and deliver power between the two gear units. Because the two gear units are same in the shape, the two gear units can be molded in one mold, and the two gear units are assembled in the base easily. Then the manufacture cost of the gear-rolling apparatus is reduced, and the gear-rolling apparatus can be assembled easily.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
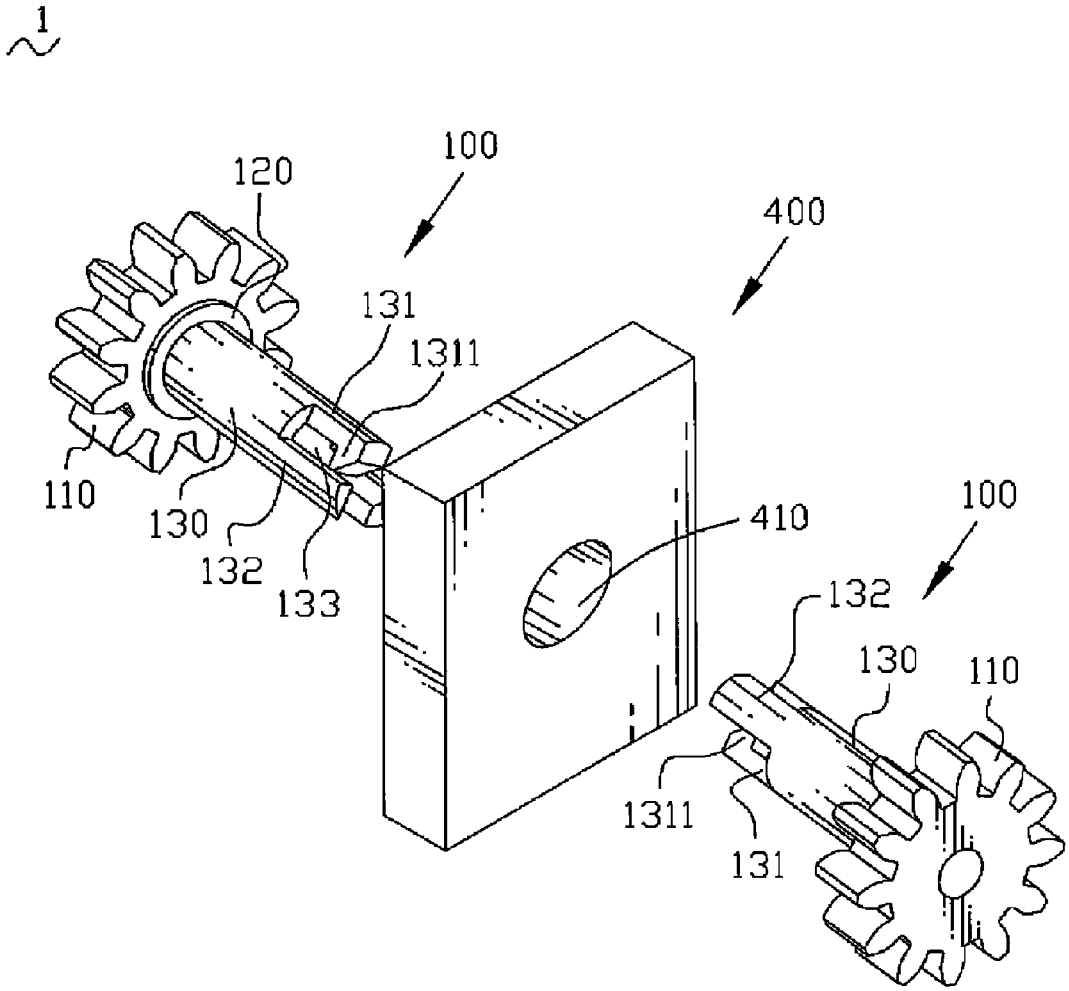
FIG. 1 is an exploded perspective view of a gear-rolling apparatus according to the present invention.

Referring to FIG. 1, a gear-rolling apparatus 1 of the present invention comprises two gear units 100 and a base 400. The base 400 is a rectangular solid, and a round hole 410 is opened in the base 400. The two gear units 100 are same.

Figure 2:
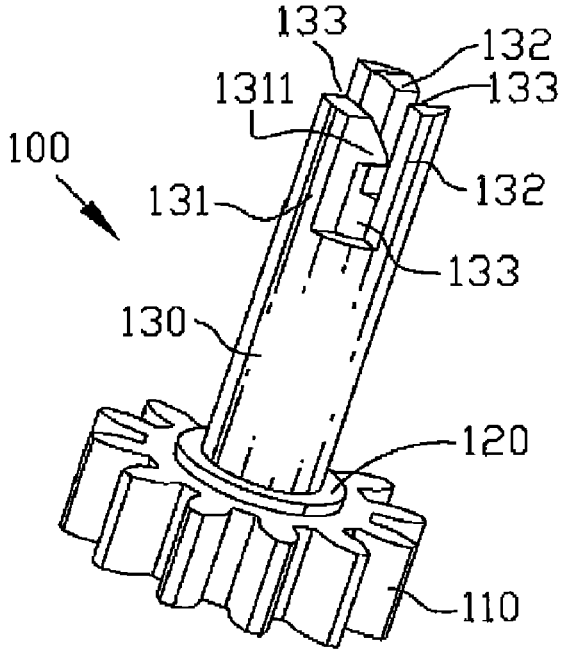
FIG. 2 is a perspective view of a gear unit of the gear-rolling apparatus.
Figure 3:
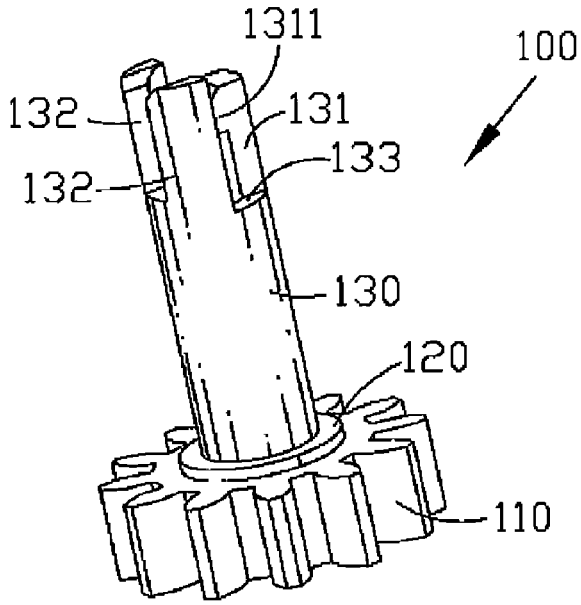
FIG. 3 is another perspective view the gear unit of the gear-rolling apparatus.

Please referring to FIGS. 2 and 3, the gear unit 100 has a rolling portion 110. A ring base 120 extends from a center of one side of the rolling portion 110. A rolling shaft 130 having a column shape extends from the center of the ring base 120. A clicking column 131 and two location columns 132 as connecting portions extend from edges of a free end of the rolling shaft 130 along an axle direction of the rolling shaft 130. The clicking column 131 and the two location columns 132 are spaced out from each other to form three grooves 133 therebetween. Two side surfaces of the clicking column 131 are parallel with each other, the clicking column 131 has a same size with and is symmetrical about the groove 133 between the two location columns 132. Two side surfaces of each location column 132 gradually approach to each other from outside to inside, each location column 132 has a same size with and is symmetrical about the groove 133 between the other location column 132 and the clicking column 131. A clicking clasp 1311 extends inward from the top of the clicking column 131, the clicking clasp 1311 has an inclined inner surface which inclines inward from top to bottom.

Figure 4:
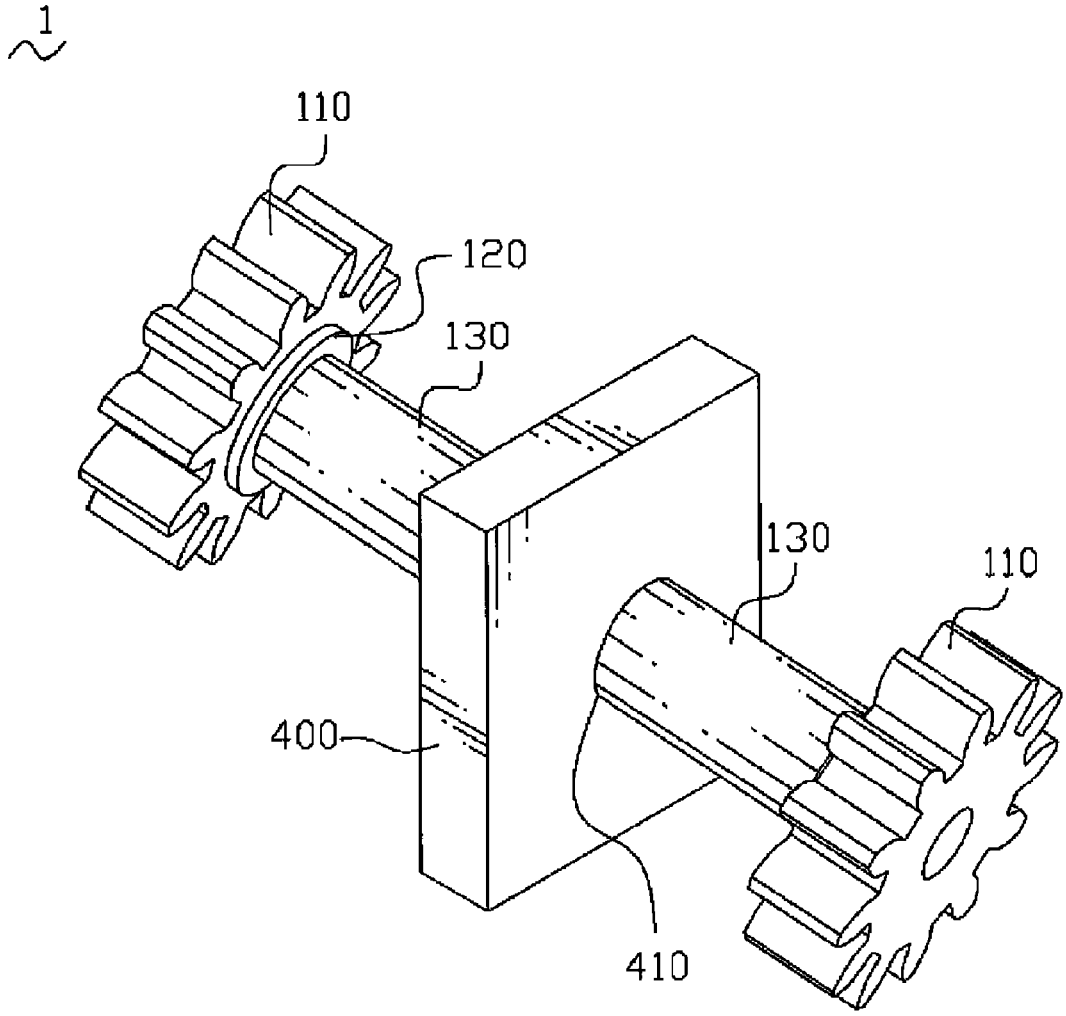
FIG. 4 is an assembled perspective view of the gear-rolling apparatus.

Referring to FIG. 1 and FIG. 4, while the gear-rolling apparatus 1 is assembled, the two rolling shafts 130 are inserted into the round hole 410 of the base 400, the rolling shafts 130 connects the two gear units 100 as a whole, the assembled action is finished.

Figure 5:
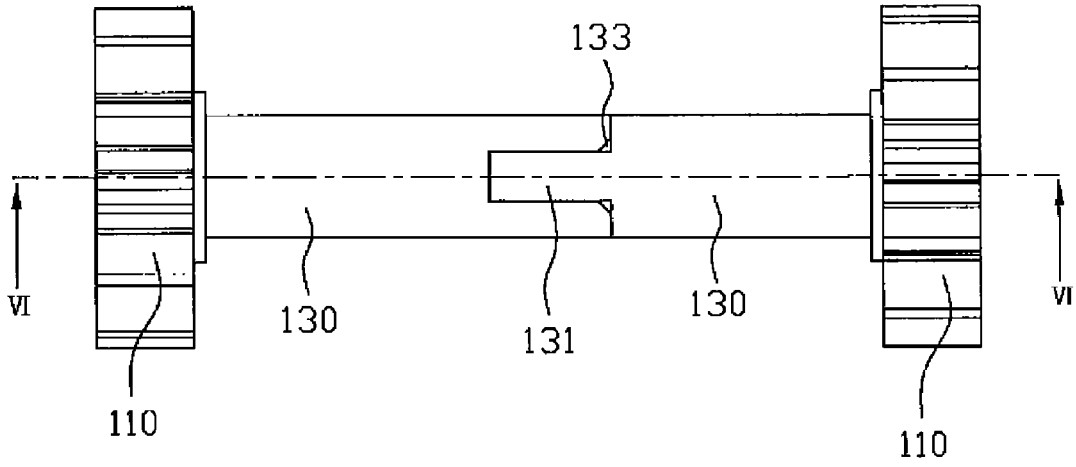
FIG. 5 is a side view of two gear units of the gear-rolling apparatus connected together.
Figure 6:
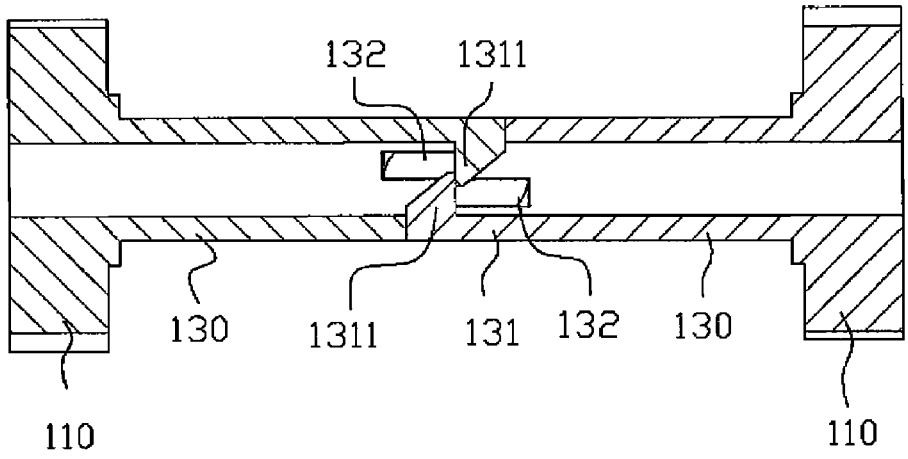
FIG. 6 is a cross-sectional view taken along line VI-VI of FIG. 5.
Figure 7:
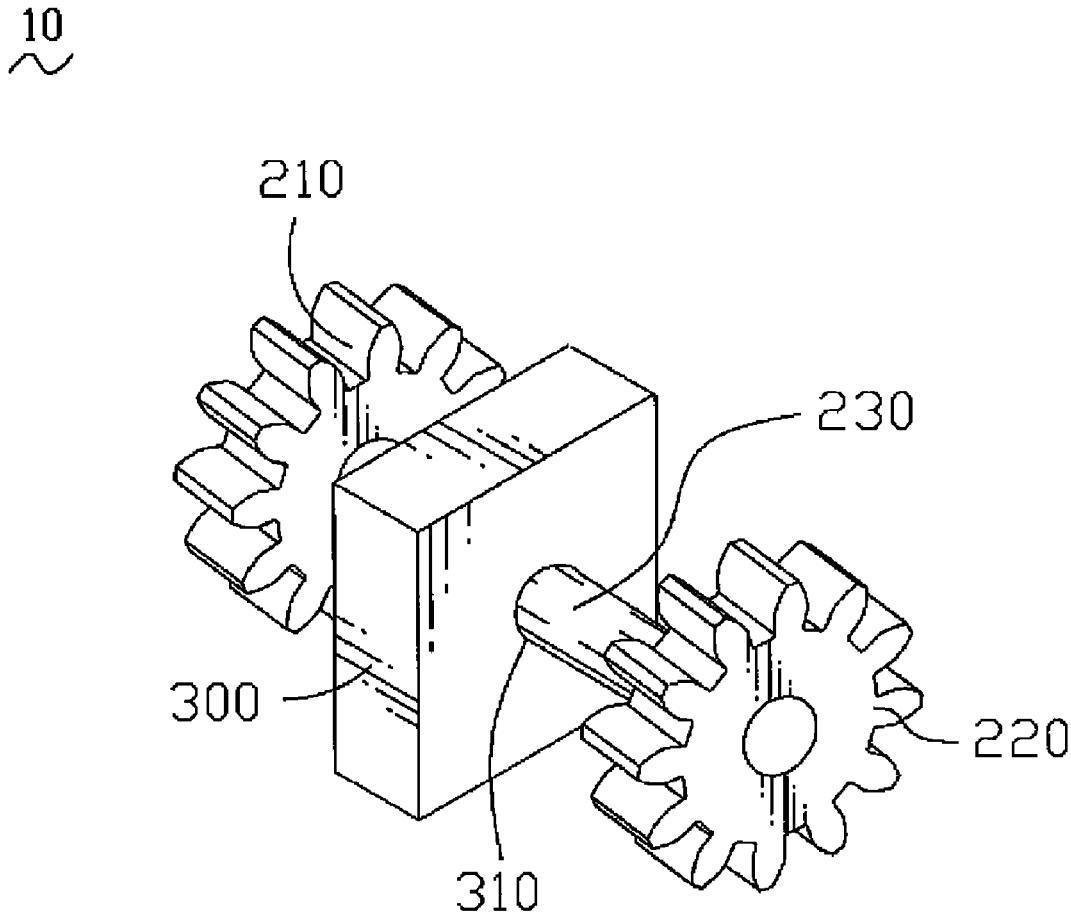
FIG. 7 (Prior Art)
FIG. 7 is a perspective view of a traditional gear-rolling apparatus.

Please refer to FIGS. 5 and 6, while the two rolling shafts 130 connects with each other, the clicking column 131 of one of the rolling shafts 130 is inserted into the groove 133 opened between the location columns 132 of the other rolling shaft 130, and the location columns 132 of one of the rolling shafts 130 are inserted into the grooves 133 opened between the clicking column 131 and the location columns 132 of the other rolling shaft 130 respectively. Because the clicking column 131 and the location column 132 just match the corresponding grooves 133, the rolling shafts 130 do not have a relative movement therebetween. The inclined inner surface of the clicking clasp 1311 of one of the rolling shafts 130 slides along the inclined inner surface of the clicking clasp 1311 of the other rolling shaft 130, when the two rolling shafts 130 are inserted into each other completely, bottom surfaces of the two clicking clasps 1311 are just against each other for avoiding the rolling shafts 130 moving up and down. Then the two rolling shafts 130 are assembled as a unit firmly.

The present invention is achieved by the two rolling shafts 130, using the clicking column 131 and the location columns

132 of the rolling shaft 130 to fix the two gear units 100 and deliver power between the two gear units 100. Because the two gear units 100 are same in the shape, the two gear units 100 can be molded in one mold, and the two gear units 100 are assembled in the base 400 easily. Then the manufacture cost of the gear-rolling apparatus 1 is reduced, and the gear-rolling apparatus 1 can be assembled easily.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A gear-rolling apparatus, assembled by a pair of gear units, each of the gear unit comprising:

a rolling portion;

a rolling shaft extending from the rolling portion; and a clicking column and two location columns extending from edges of a free end of the rolling shaft along an axle direction of the rolling shaft, the clicking column and the two location columns spaced out from each other to form three grooves therebetween, a clicking clasp extending inward from the top of the clicking column, the clicking clasp having an inclined inner surface which inclines inward from top to bottom, the two rolling shafts inserted into the hole of the base, the clicking column of one of the rolling shafts mating the groove opened between the location columns of the other rolling shaft, the location columns of one of the rolling shafts mating the grooves opened between the clicking column and the location columns of the other rolling shaft respectively, bottom surfaces of the two clicking clasps being against each other.

2. The gear-rolling apparatus as set forth in claim 1, wherein the two rolling shafts are the same.

3. The gear-rolling apparatus as set forth in claim 2, wherein the clicking column has a same size with and is symmetrical about the groove between the two location columns.

4. The gear-rolling apparatus as set forth in claim 3, wherein the clicking column has two side surfaces parallel with each other.

5. The gear-rolling apparatus as set forth in claim 3, wherein each location column has a same size with and is symmetrical about the groove between the other location column and the clicking column.

6. The gear-rolling apparatus as set forth in claim 5, wherein each location column has two side surfaces gradually approaching to each other from outside to inside.

7. The gear-rolling apparatus as set forth in claim 1, wherein the rolling portion extends from a center thereof to form a ring base, the rolling shaft extends from the center of the ring base.

* * * * *